US005097174A

United States Patent [19]

D'Amato

[11] Patent Number: 5,097,174

[45] Date of Patent: Mar. 17, 1992

[54] COLOR PICTURE TUBE HAVING AN IMPROVED INTERNAL MAGNETIC SHIELD

[75] Inventor: Ralph J. D'Amato, Lancaster, Pa.

[73] Assignee: Thomson Consumer Electronics, Inc., Indianapolis, Ind.

[21] Appl. No.: 618,186

[22] Filed: Nov. 23, 1990

[51] Int. Cl.[5] ..... H01J 29/06

[52] U.S. Cl. ..... 313/402; 313/407

[58] Field of Search ..... 313/402, 407, 479; 315/85

[56] References Cited

U.S. PATENT DOCUMENTS

| | | | |
|---|---|---|---|
| 3,867,668 | 2/1975 | Shrader | 315/8 |
| 4,019,085 | 4/1977 | Sakata | 313/402 |
| 4,229,675 | 10/1980 | Matsuki et al. | 313/402 |
| 4,580,076 | 4/1986 | Shimoma et al. | 313/402 |
| 4,622,490 | 11/1986 | Benway | 313/402 |
| 4,758,193 | 7/1988 | Brown | 445/1 |

*Primary Examiner*—Sandra L. O'Shea

*Attorney, Agent, or Firm*—J. S. Tripoli; D. H. Irlbeck; L. L. Hallacher

[57] ABSTRACT

An internal magnetic shield for a color picture tube has lower reluctance in the sides of the shield than the top and bottom of the shield.

6 Claims, 2 Drawing Sheets

COLOR PICTURE TUBE HAVING AN IMPROVED INTERNAL MAGNETIC SHIELD

This invention relates to a color picture tube, and particularly to such a tube having an internal magnetic shield providing improved shielding in three magnetic fields.

BACKGROUND

A color picture tube includes a faceplate and a funnel which are integrally joined together. The inside surface of the faceplate is covered with a phosphor screen composed of triads of phosphor elements which emit the three primary colors of light, red, green and blue when impacted by electrons. An electron gun is mounted in a neck portion which is attached to the funnel in a position remote from the faceplate. The electron gun provides three electron beams which are used to scan the phosphor pixels to cause the desired image to be displayed. A shadow mask is arranged in the proximity of the phosphor screen and is used as a color selection electrode to assure that each of the three electron beams impacts the phosphor of the proper light emitting color. Thus, for example, the electron beam which is modulated with the red data impacts the phosphor pixels which emit red light. Because the electrons are charged particles, the Earth's magnetic field has an influence on their trajectories which can cause the electrons to impact a phosphor of the improper color, a phenomena known as misregistry. For this reason, a magnetic shield is commonly used, either in the interior or the exterior, of the picture tube, to shield a substantial portion of the electron beam trajectories from the influence of the Earth's magnetic field. Most recent tubes utilize an interior magnetic shield (IMS) which is attached to the shadow mask and extends toward the electron gun.

The magnetic effect on electron beams, which causes misregistry, occurs in the directions which are perpendicular to the longitudinal axis of the tube. For this reason, various changes in the configuration, or structure, of the internal magnetic shield can beneficially influence the misregistration in one direction and adversely influence it in an orthogonal direction. Misregistry must be corrected in all three field directions: axial, horizontal, and vertical. The axial (north-south) field acts parallel to the longitudinal axis of the tube. The horizontal (east-west) and vertical fields act along the horizontal and vertical axes of the faceplate, respectively. In the early prior art, the vertical field was shielded from the interior of the tube by enclosing the interior of the tube as completely as possible. This entailed attaching an internal shield to the mask and minimizing the size of the opening facing the electron gun. In later prior art, the axial field was reshaped to have a vertical component by the formation of V-notches on the sides of the shield which enlarged the rear opening facing the electron gun but degraded the vertical-field shielding. Since the horizontal field is reshaped by the shadow mask, the shield generally interferes with this function of the shadow mask. This interference is reduced in the prior art by placing vertical cuts in the shield to section it horizontally, e.g., by placing vertical slots along the minor axis of the shield. These cuts, or slots, further reduce the enclosure of the tube interior by the shield, thus further degrading the vertical-field shielding ability of the shield. Thus, the prior art is generally deficient in providing adequate shielding in all three fields. The present invention is directed to a tube having an internal magnetic shield which has a favorable influence on electron beam misregistry in all directions.

SUMMARY

A color picture tube having a substantially rectangular faceplate and an integral funnel, includes a substantially rectangular internal magnetic shield extending into the funnel, the reluctance of the material in the sides of the magnetic shield is substantially less than the reluctance of the material in the top and bottom of the magnetic shield.

DETAILED DESCRIPTION

Figure 1:
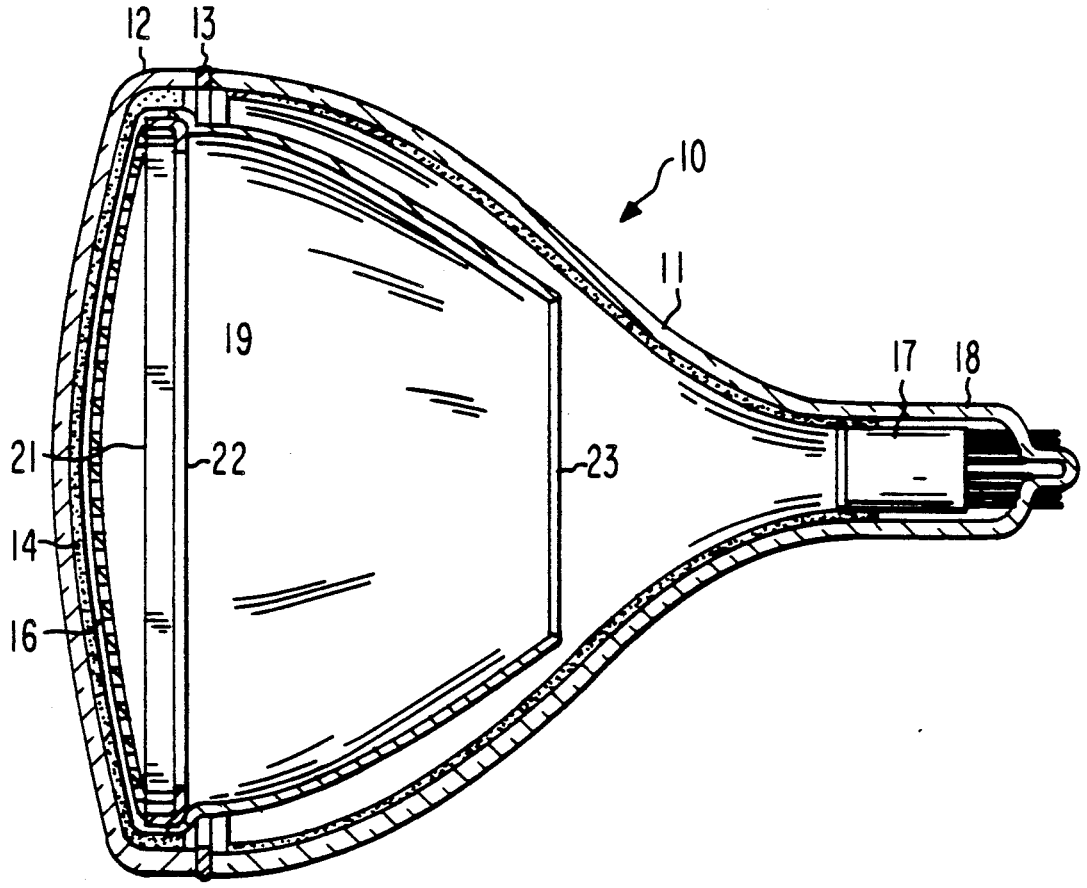
FIG. 1 is a cross sectional view of a color picture tube including a novel internal magnetic shield.

In FIG. 1, a color picture tube 10 includes a funnel 11 and a faceplate 12 which are integrally joined at a frit seal line 13. A phosphor screen 14 is arranged on the inside surface of the faceplate 12. The phosphor screen 14 is composed of triads of phosphors each of which emits one of the three primary colors of light when impacted by one of three electron beams. A shadow mask 16 is spaced from the phosphor screen 14 and is used to direct the three electron beams to the phosphors which emit the appropriate colors of light. An electron gun 17 is arranged in a neck portion 18 of the kinescope 10 and provides the three electron beams which are used to scan the phosphors of the screen 14.

The electrons are charged particles, and accordingly the electron beams are subject to deflection because of the influence of the Earth's magnetic field. The effects of the Earth's magnetic field are minimized by utilizing an internal magnetic shield 19. The shield 19 is composed of a ferromagnetic material, such as cold rolled AK steel or low carbon cold rolled steel, which bends, or redirects, the magnetic field lines of the Earth around the electron beams to minimize the effects on the beams as they pass through the shield. This is an important feature because the electron beam deflection caused by the Earth's magnetic field can cause a particular electron beam to hit a phosphor of the wrong light emitting color, thus resulting in misregistry and thereby degrading the quality of the image display. Additionally, when a television receiver including the tube is moved from one position to another, the relative position of the axis of the tube with respect to the Earth's magnetic field changes, thereby possibly causing substantial degradation of the image display because of additional misregistration of the electron beams.

Figure 2:
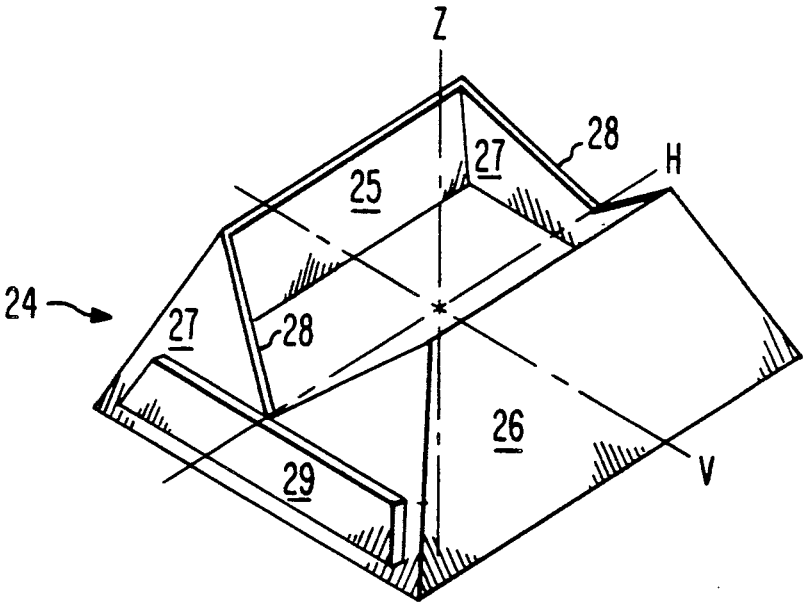
FIGS. 2, 3 and 4 are preferred embodiments.

In FIG. 2, an internal magnetic shield 24 is fabricated from an integral piece of ferromagnetic material. The shield 24 is trapezoidal in shape with a substantially rectangular cross section similar to the rectangular configuration of the faceplate of the tube. The shield 24 is arranged in the faceplate with the wide opening of the shield in the proximity of the faceplate and the narrow opening extending toward the electron gun. Accordingly, the long sides 25 and 26 of the shield, respectively are the top and bottom of the shield. The short sides 27 are the vertical sides of the shield 24. The short sides 27 are provided with V-notches 28, which reshape the axial field to have a vertical component to enhance the north-south shielding. However, as explained hereinabove, such notches degrade the vertical field shielding.

Vertical field shielding can be optimized by decreasing the reluctance of shield 24 in the vertical direction. In the FIG. 2 embodiment this is accomplished by fixing (preferably by welding), a strip 29 of ferromagnetic material to each of the short sides 27. Such strips of material decrease the reluctance of a portion of the sides 27 and thus substantially improves the vertical field shielding. As an example, many internal magnetic shields are made of 0.15 mm ferromagnetic material. The reluctance of the side walls 27 of such shields can be reduced by more than 25% by affixing strips also having a 0.15 mm thickness to the vertical sides of the shield. The decreased reluctance enhances the vertical shielding of the shield 24.

Figure 3:
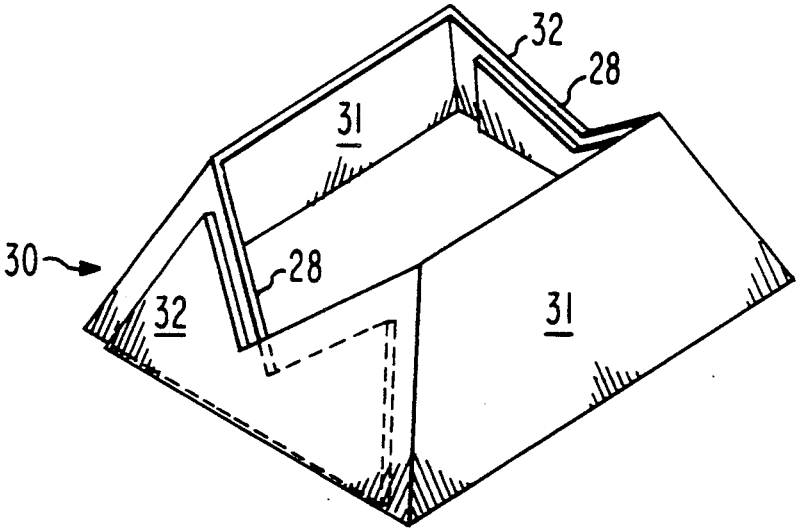

FIG. 3 is a preferred embodiment of an internal magnetic shield 30 which is composed of two identical channel shaped members 31. The short sides 32 contain the V-notches 28. Because the two channel shaped members 31 are identical the short sides 32 also are identical. The two members 31 are permanently joined in any convenient manner, preferably by welding, so that the short sides overlap. Accordingly, in this embodiment the total thickness of the material in a portion of the short sides 32 is twice that of the material in the long sides 31 (top and bottom) and the reluctance of the short sides therefore is also one-half of that of the other portions of the shield.

Figure 4:
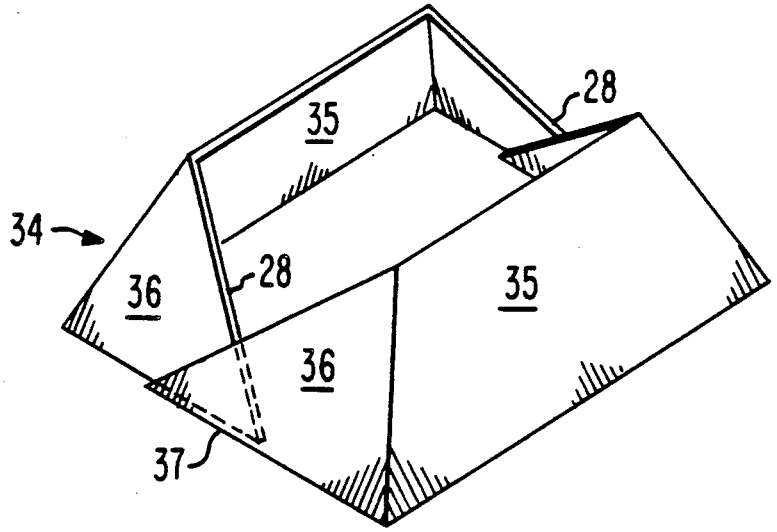

FIG. 4 is another preferred embodiment of an internal magnetic shield 34 which is composed of two identical channel shaped members 35. The vertical sides 36 are substantially triangular in configuration and, thus when the two pieces 35 are joined into an integral unit the V-notches 28 are formed and there is an overlapping portion 37 where the effective thickness of the material in the short sides is double that of the rest of the shield to lower the reluctance in the sides 36. However, because the overlap is smaller than in the FIG. 3 embodiment the decrease of reluctance is not as large as it is for the FIG. 3 embodiment. However, a significant enhancement of the vertical field shielding is obtained.

The invention is advantageous because it allows the use of thinner material for the shield. For example, larger tubes, such 35 V, used 0.25 mm thick material. This can be a problem in shock testing because of the additional weight. The invention allows the use of 0.15 mm material while maintaining the required shielding in the vertical sides because the overlapping of the sides results in 0.3 mm thick material in at least a portion of the sides.

What is claimed is:

1. In a color picture tube having a substantially rectangular faceplate and an integral funnel and including a substantially rectangular internal magnetic shield having vertical short sides and horizontal long sides, and extending into said funnel, an improvement wherein:

the reluctance of the material in said vertical short sides is substantially less than the reluctance of the material in said horizontal long sides, and said vertical short sides include a V-shaped slot.

2. The improvement of claim 1 wherein the reluctance of the material in at least a portion of said vertical short sides is approximately one-half that of the material in said horizontal long sides.

3. In a color picture tube having a substantially rectangular faceplate and an integral funnel and including a substantially rectangular internal magnetic shield having vertical short sides and horizontal long sides and extending into said funnel, an improvement wherein:

the thickness of the material in at least a portion of said vertical short sides is substantially greater than the thickness of the material in said horizontal long sides, and said vertical short sides include a V-shaped slot.

4. The improvement of claim 3 wherein the thickness of the material in said portion of said vertical short sides is approximately twice the thickness of the material in said horizontal long sides.

5. The improvement of claim 3 wherein said magnetic shield is composed of two channel-shaped members and said vertical short sides are formed by overlapping at least a portion of the sides of said channel-shaped members.

6. The improvement of claim 3 wherein said magnetic shield is composed of an integral piece of material and said vertical short sides include a strip of ferromagnetic material attached thereto.

* * * * *